US008528245B2

(12) United States Patent
Chvala

(10) Patent No.: US 8,528,245 B2
(45) Date of Patent: Sep. 10, 2013

(54) SINGLE SHOTGUN SHELL MOUNTING DEVICE

(75) Inventor: John R. Chvala, Grafton, WI (US)

(73) Assignee: Advanced Technology International USA, LLC, Milwaukee, WI (US)

( * ) Notice: Subject to any disclaimer, the term of this patent is extended or adjusted under 35 U.S.C. 154(b) by 147 days.

(21) Appl. No.: 13/104,389

(22) Filed: May 10, 2011

(65) Prior Publication Data

US 2012/0285066 A1 Nov. 15, 2012

(51) Int. Cl.
*F41C 27/00* (2006.01)

(52) U.S. Cl.
USPC ..... 42/90; 224/251; 224/931

(58) Field of Classification Search
USPC ..... 224/931, 191, 239, 242, 245, 251, 224/271, 272; 206/3; 42/90, 106; 89/34
See application file for complete search history.

(56) References Cited

U.S. PATENT DOCUMENTS 5,924,613 A * 7/1999 Johnson et al. ..... 224/195
2005/0217470 A1* 10/2005 Bevacqua ..... 89/34
2010/0263255 A1* 10/2010 Harris ..... 42/90

OTHER PUBLICATIONS

Benelli M4—Sidearmor Rail Review. <http://www.benelliusa.com/forum/showthread.php/19212-Benelli-M4-Sidearmor-Rail-Review>. Jun. 12, 2009.*

* cited by examiner

*Primary Examiner* — Gabriel Klein
(74) *Attorney, Agent, or Firm* — Andrus, Sceales, Starke & Sawall, LLP

(57) ABSTRACT

A shotgun mountable shell holder is provided for holding a single shotgun shell therein. The shell holder includes a rigid body having an external mounting surface provided with a track slidably mounted and frictionally retained on a rail arrangement having at least one rail attached externally of a shotgun. The rigid body also includes an internal shell receiving and engaging structure sized and shaped to slidably receive and frictionally retain the single shotgun shell therein. The track and the rail have mating dovetail-shaped cross sections.

18 Claims, 3 Drawing Sheets

SINGLE SHOTGUN SHELL MOUNTING DEVICE

BACKGROUND OF THE INVENTION

The present disclosure relates generally to an auxiliary ammunition carrier for use with a firearm, and more particularly, pertains to a shotgun shell mounting device for releasably retaining a single shotgun shell in a convenient position on an external surface of the shotgun.

It is well known that it is often desirable or necessary to have an extra shell available for rapid loading of a shotgun when the internal supply of ammunition within the gun has been depleted. In an effort to provide a readily accessible ammunition supply to a shooter in the field, many devices exist which allow the user to carry numerous rounds of ammunition away from the shotgun. For example, several different types of ammunition carrying belts, harnesses, straps, pouches, packs and other personal storage devices exist which are well known in the art. Unfortunately, all of these devices have a common problem. They are all directed to carrying ammunition on the shooter's person.

In order to access ammunition from bodily carried storage containers, the shooter must take one or both of his or her hands away from his or her weapon in order to grasp the individual rounds and then bring his or her hands back to the weapon in order to chamber the round. While such action is not especially difficult, it results in a lowering of the shotgun and make take several critical seconds causing the shooter to lose sight of the target thus making the availability of additional rounds of ammunition moot.

To overcome the shortcomings of bodily carried storage containers, various shotgun shell holders have been developed which, by means of conventional fasteners, are attached and detached from stocks, forends, and other external portions of the shotgun in an attempt to quickly supply an additional round to the shotgun without reducing the readiness of the shotgun.

There remains a need for an individual shotgun shell holder which may be readily attached and detached externally of a shotgun, and preferably outside the receiver thereof, so as to permit quick and easy reloading of the shotgun. There is an additional need for a single shotgun shell holder which, in use, does not interfere with the normal operation of the shotgun. Further, there is a need for a single shotgun shell holder which can be adjustably positioned externally of the shotgun, and which effectively retains a shotgun shell therein to prevent an accidental loss of reserve ammunition.

SUMMARY OF THE INVENTION

The present disclosure relates to an auxiliary ammunition mounting device for holding a single round of ammunition. The mounting device includes a body having an external mounting surface provided with a track adapted to slidably receive a rail attached to a firearm, and an internal ammunition receiving and engaging structure sized and shaped to removably receive and retain the single round of ammunition.

In an exemplary embodiment, the track has a mounting axis oriented in a direct transverse to a central axis of the ammunition receiving and engaging structure. The external mounting surface includes a slot spaced from the track for receiving and holding a resilient retaining element that is frictionally engageable with the single round of ammunition, and forms part of the ammunition receiving and engaging structure. The ammunition receiving and engaging structure includes a rounded ammunition receiving surface that extends completely through the body. The resilient retaining element projects inwardly from and extends at least partially around the ammunition receiving surface. The track is formed therethrough with an aperture configured to receive a fastener that is adapted to be secured to the rail.

The present disclosure further relates to a shotgun mountable shell holder for holding a single shotgun shell therein. The shell holder includes a rigid body having an external mounting surface provided with a track slidably mounted and frictionally retained on a rail arrangement having at least one rail attached externally of a shotgun, and an internal shell receiving and engaging structure sized and shaped to slidably receive and frictionally retain the single shotgun shell therein. The track and the rail have mating dovetail-shaped cross sections.

The track is mounted on a rail attached externally of a receiver of the shotgun. The body has an outer surface that includes a pair of spaced apart open end faces interconnected by an arcuate portion having a pair of sidewalls depending from opposite sides of the arcuate portion. The external mounting surface joins the end faces and the sidewalls, and is engageable against a rail mounting surface to which the rail is secured. The track is formed with a notch that extends continuously along the external mounting surface and opens through the sidewalls. A slot opens through the external mounting surface between one of the end faces and the track for receiving and retaining a resilient retaining element that is frictionally engageable with an outer wall of the shotgun shell, and forms part of the shell receiving and engaging structure. The track has a mounting axis that runs in a direction perpendicular to the sidewalls. The body has a keyhole-shaped inner surface which includes a rounded shell receiving surface and a channel portion in communication therewith. The shell receiving surface and the channel portion are in communication with the slot. The shell receiving surface is radially spaced from a central axis that extends in a direction transverse from the mounting axis of the track. The resilient retaining element projects inwardly from and extends at least partially around the shell receiving surface. The channel portion is provided with an aperture that opens into the track and is configured to receive a fastener that is adapted to be secured to the rail. The aperture receiving the fastener is aligned with a hole formed through the arcuate portion and adapted to provide access to a tool engageable with the fastener. In a typical use, each body is mounted in a group on the rail arrangement such that the shotgun shells held in the bodies are disposed both vertically and horizontally.

BRIEF DESCRIPTION OF THE DRAWINGS

The drawings illustrate the best mode presently contemplated in carrying out the disclosure. In the drawings.

DETAILED DESCRIPTION OF THE INVENTION

Figure 1:
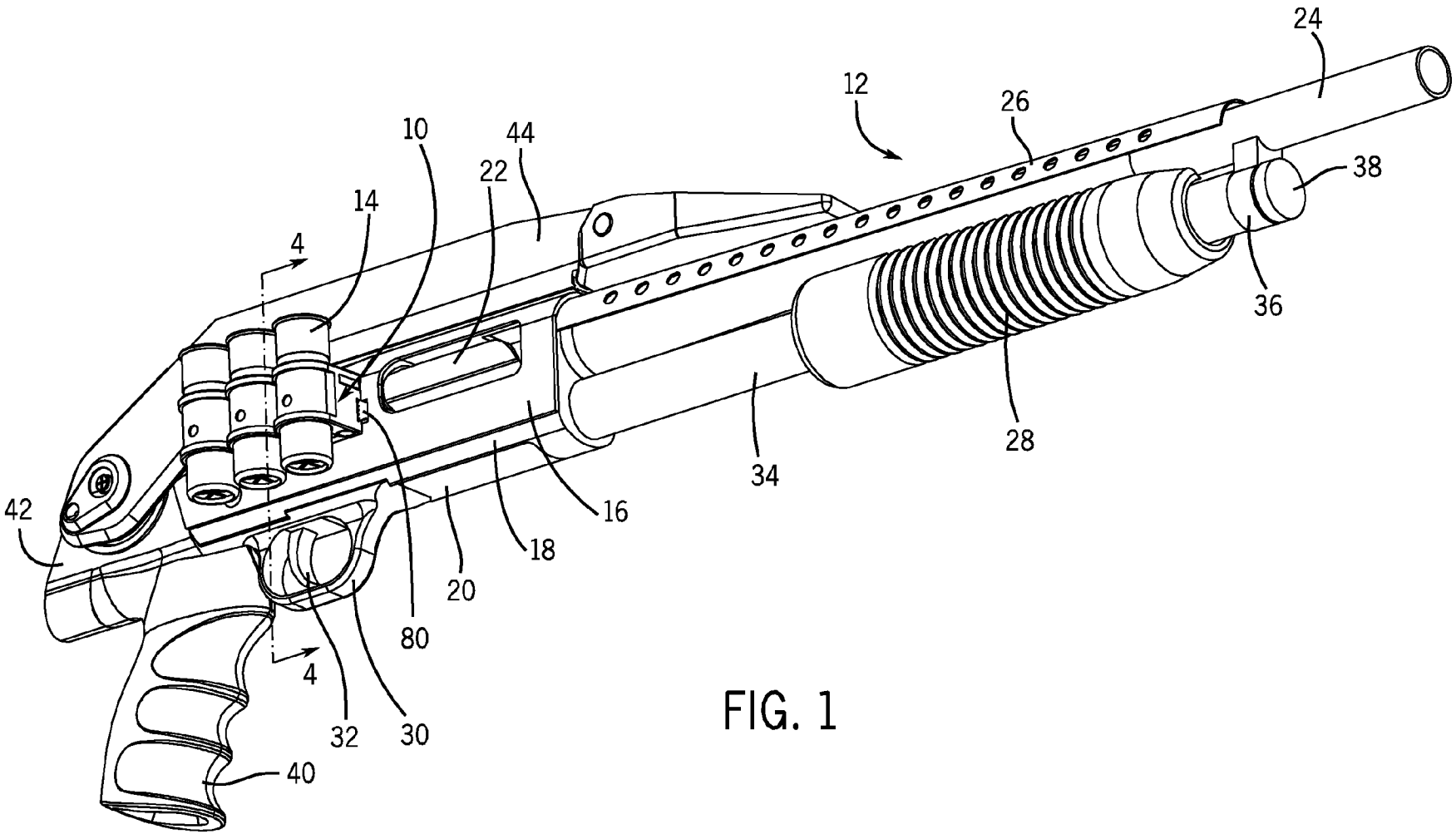
FIG. 1 is a perspective view showing one side of the shotgun provided with an exemplary mounting arrangement of individual shotgun shell holders, each holder enabling the retention of a single shotgun shell therein.
Figure 2:
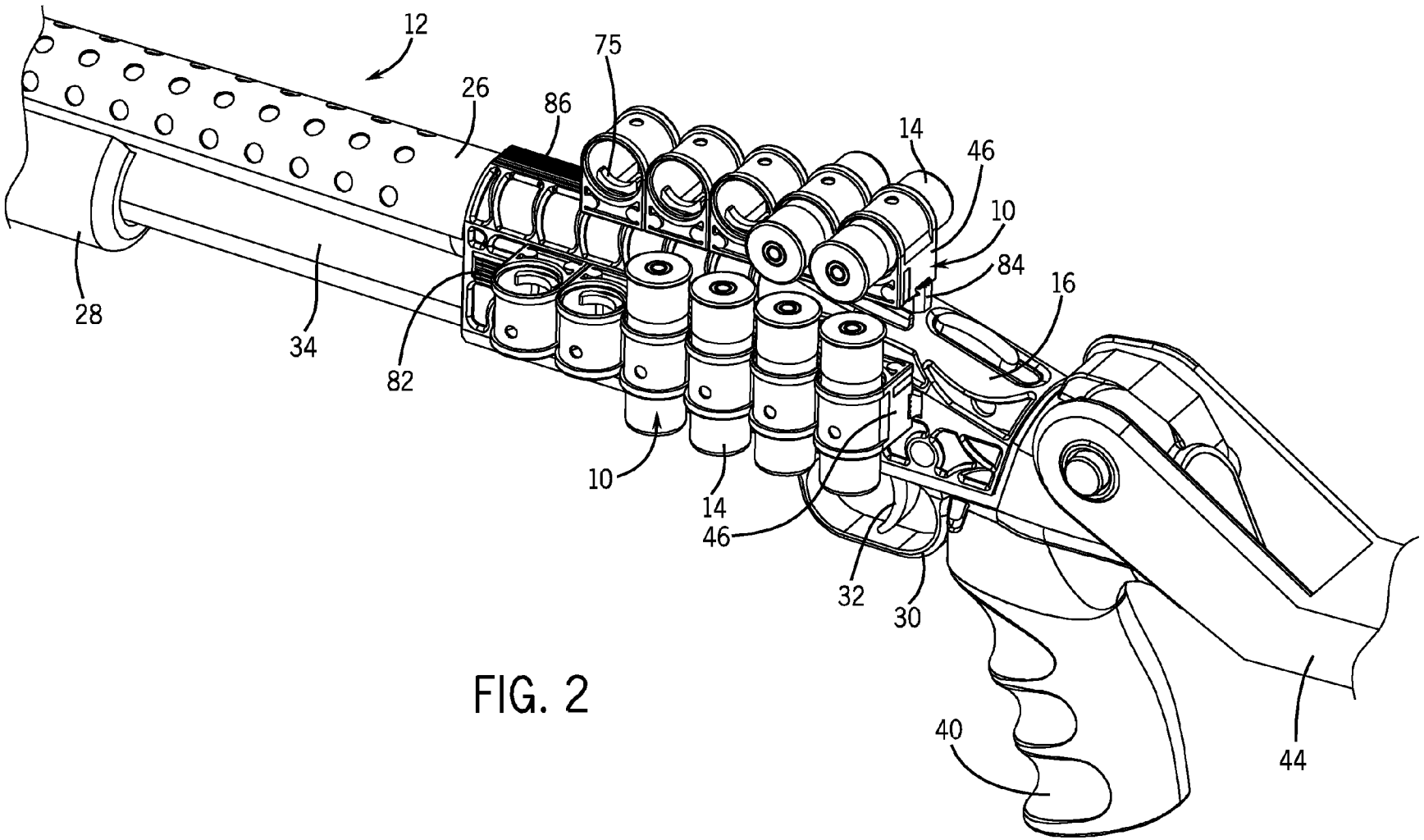
FIG. 2 is a fragmentary perspective view showing an opposite side of the shotgun provided with a further exemplary mounting arrangement of individual shotgun shell holders of the type shown in FIG. 1.

Referring now to the drawings, FIGS. 1 and 2 illustrate various mounting arrangements of auxiliary ammunition carriers in the form of individual shotgun shell holders 10 which are separately and removably mounted externally on a shotgun 12, and are each designed to releasably retain a single reserve, tubular shotgun shell 14 therein.

In the exemplary embodiment shown, the single shotgun shell holders 10 are specifically coupled to a receiver structure that includes an accessory mount 16 disposed on a receiver 18 of the shotgun 12 as more fully described in pending U.S. patent application Ser. No. 13/104,104, filed May 10, 2011. The receiver 18 includes a bottom loading port 20 for receiving live shotgun shells, and a side ejection port 22 for ejecting spent shotgun shells from an internal firing chamber. The shotgun 12 includes a barrel 24 having a cover 26, a gripping, slidable forend 28, a trigger guard 30 and a trigger 32. The shotgun 12 shown also includes a cartridge-storing magazine tube 34 that extends longitudinally from the receiver 18 and below the barrel 24 with a forward portion of the mounting tube 34 engaging a barrel lug 36 and held thereto by a magazine cap 38. In addition, the shotgun 12 is equipped with a pistol grip 40 connected via a mounting device 42 below and at the rear end of the receiver 18. An over the top stock 44 can be pivotally moved on the shotgun 12 from a retracted position over the accessory mount 16 and barrel cover 26 to an extended portion for engagement with a shooter's shoulder.

Figure 3:
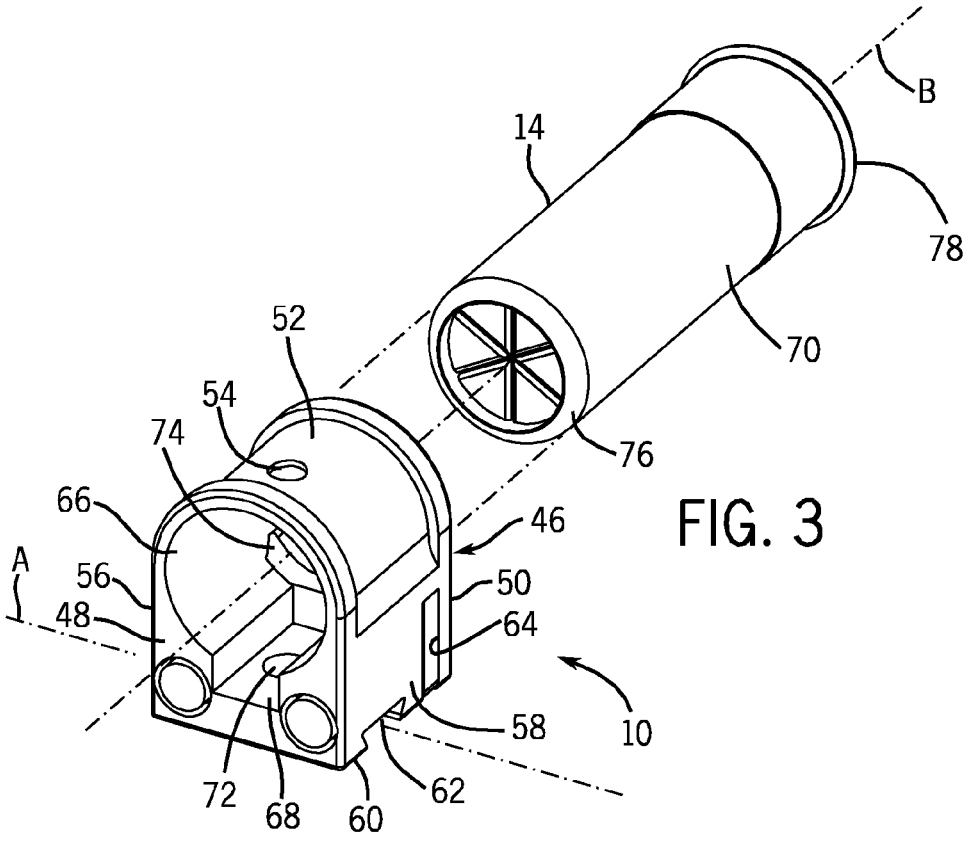
FIG. 3 is an exploded view of a shotgun shell removed from an individual shotgun shell holder of the type shown in FIGS. 1 and 2.
Figure 4:
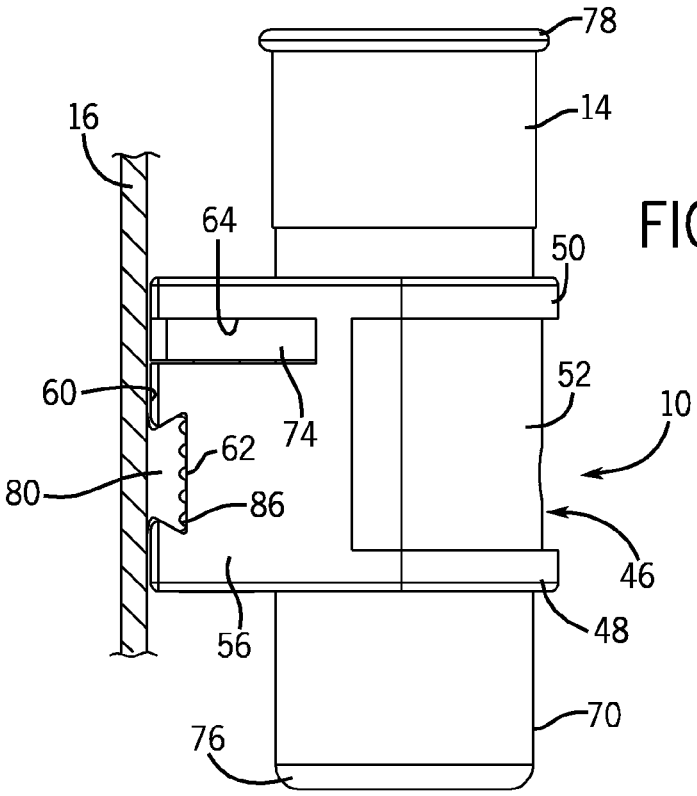
FIG. 4 is a sectional view of the individual shotgun shell holder taken on line 4-4 of FIG. 1.

Referring now to FIGS. 3 and 4, each single shotgun shell holder 10 is defined by a rigid carrier body 46 which is typically molded of a polymer or other solid material. The body 46 has an outer surface which includes a pair of spaced apart opposite open end faces 48, 50, and a recessed arcuate portion 52 that lies between and interconnects the end faces 48, 50 and is configured with a hole 54 therethrough. A pair of opposite sidewalls 56, 58 depends substantially vertically from the opposite sides of the arcuate portion 52, and a mounting surface 60 joins the end faces 48, 50 and the sidewalls 56, 58. The mounting surface 60 is engageable against a rail mounting surface, such as the accessory mount 16, and includes a dovetail-shaped notch 62 that extends continuously along the mounting surface 60 and opens through the sidewalls 56, 58. The notch 62 defines a mounting track for receiving a mating rail arrangement provided on the accessory mount 16 as will be further described below. The notch 62 has a longitudinal mounting axis A that runs therethrough in a direction perpendicular to the sidewalls 56, 58. A slot 64 opens through the mounting surface 60 adjacent end face 50, and extends through both sidewalls 56, 58 terminating beneath the arcuate portion 52 when viewed from the outside of the shell holder 10.

The body 46 has a keyhole-shaped inner surface which includes a rounded shell receiving surface 66 and a channel portion 68 in communication therewith. As clearly shown in FIG. 3, the channel portion 68 is spaced from the arcuate portion 52, and lies between the receiving surface 66 and the mounting surface 60. The channel portion 68 has a width which is smaller than a width or diameter of the receiving surface 66. The shell receiving surface 66 opens through the end faces 48, 50, and is sized and shaped to slidably receive an outer cylindrical sidewall 70 of the shotgun shell 14. The shell receiving surface 66 is radially spaced from a central and longitudinal axis B that extends in a direction transverse to the mounting axis A of notch 62. The channel portion 68 opens through end face 48, but is closed to end face 50. A bottom wall of the channel portion 68 is formed with an aperture 72 that is aligned with hole 54 in the arcuate portion 52, and extends through the mounting surface 60 to open into the dovetail-shaped notch 62. The shell receiving surface 66 and the channel portion 68 are both in communication with the slot 64 adjacent the end face 50. The slot 64 is constructed to receive and hold a resilient retaining element 74 that normally projects inwardly of the shell receiving surface 66 inside the end face 50 as shown by the empty shell holders 10 in FIG. 2.

The resilient retaining element 74 has a curved shell engaging surface 75 (FIG. 2) that extends partially around the shell receiving surface 66, and is designed to deform inwardly, and frictionally engage a portion of the cylindrical sidewall 70 of the shotgun shell 14 upon a slidable entry of the shotgun shell 14 into the holder 10 with a crimped end 76 of the shell 14 being the leading end. The holder 10 with its resilient retaining element 74 is designed to hold the shotgun shell 14 generally midway between the crimped end 76 and a rimmed striking end 78 of the shell 14 in a secure manner which will prevent an involuntary release and loss of the shell 14. Removal of the shotgun shell 14 from the holder 10 causes the resilient retaining element 70 to return to its initial undeformed condition.

When it is desired to add auxiliary ammunition externally of the shotgun 12, one or more holders 10 are slidably mounted and adjustably positioned by means of notches 62 onto a rail arrangement formed by one or more rails provided with mating dovetail-shaped cross sections on the shotgun 12. In FIGS. 1 and 2, three mating rails 80, 82, 84 with outer grooved surfaces 86 are provided on opposite sidewalls and an upper wall of the accessory mount 16 disposed upon the receiver 18, but it should be understood that the mating rails may vary in number. Although the frictional relationship between the rails 80, 82, 84 and the notches 62 is designed to snuggly maintain the shell holders 10 in position, a user may desire to more positively fix the position of the shell holder 10 on a rail by inserting a fastener in the shell holder aperture 72. This feature is particularly desirable for the rearwardmost and forwardmost holders 10 mounted on the rail. A tool may be inserted through the hole 54 in the arcuate portion 52 to screw the fastener into the rail. After the desired number and position of shell holders 10 have been mounted on rails 80, 82, 84, each holder 10 is provided with a single shotgun shell 14 which is slidably received and frictionally retained in its individual holder 10.

As seen in FIGS. 1 and 2, the individually held shells 14 are disposed vertically and horizontally outside the receiver 18 of the shotgun 12 owing to the transverse orientation of the track defined by notch 62 relative to the shell receiving surface 66. The shell holders 10 are conveniently positioned outside the receiver 18 near the user's shooting hand. When the internal supply of shotgun ammunition is exhausted, a user can easily access and extract each shotgun shell 14 from its holder 10 by grasping the rimmed striking end 78, and quickly manually loading each shell 14 into the shotgun 12 with one hand while holding the shotgun 12 with the other hand. Storage and retrieval of each shell 14 can be accomplished without interfering with the normal use of the shotgun 12.

While the holder 10 has been described above with reference to shotguns shells 14, it should be appreciated by those skilled in the art that the mounting device of the present disclosure can be conveniently adapted for use with firearm ammunition of different shapes (e.g. cartridges and shells) and with various types of firearms. In recognizing this modification, the individual shotgun shell holders 10 would be appropriately designed to accommodate the differently shaped ammunition.

Various alternatives are contemplated as being within the scope of the following claims particularly pointing out and distinctly claiming the subject matter regarded as the invention.

What is claimed is:

1. An auxiliary ammunition mounting device for holding a single round of ammunition comprising:

a body having an external mounting surface joined to an arcuate portion and provided with a track adapted to slidably receive a rail attached to a firearm, and an internal ammunition receiving and engaging structure sized and shaped to removably receive and retain the single round of ammunition, wherein the internal ammunition receiving and engaging structure includes a rounded ammunition receiving surface that extends completely through the body and a channel portion spaced from the arcuate portion and formed with an aperture that opens into the track and is configured to receive a fastener that is adapted to be secured to the rail, and wherein the aperture is aligned with a hole formed through the arcuate portion and adapted to provide access to a tool engageable with the fastener.

2. The mounting device of claim 1, wherein the track has a longitudinal mounting axis oriented in a direction transverse to a central and longitudinal axis of the ammunition receiving and engaging structure.

3. The mounting device of claim 1, wherein the external mounting surface includes a slot spaced from the track for receiving and holding a resilient retaining element that is frictionally engageable with the single round of ammunition, and forms part of the ammunition receiving and engaging structure.

4. The mounting device of claim 1, wherein the resilient retaining element projects inwardly from and extends at least partially around the ammunition receiving surface.

5. The mounting device of claim 1, wherein the channel portion lies between the rounded ammunition receiving surface and the external mounting surface, and has a width smaller than a diameter of the rounded ammunition receiving surface.

6. A shotgun mountable shell holder for holding a single shotgun shell therein comprising:

a rigid body having an external mounting surface joined to an arcuate portion and provided with a track slidably mounted and frictionally retained on a rail arrangement having at least one rail attached externally of a shotgun, and an internal shell receiving and engaging structure having a rounded shell receiving surface that extends completely through the body and is sized and shaped to slidably receive and frictionally retain the single shotgun shell therein, wherein the track and the rail have mating dovetail-shaped cross sections, and wherein the internal shell receiving and engaging structure includes a channel portion spaced from the arcuate portion and formed with an aperture that opens into the track and is configured to receive a fastener that is secured to the rail, wherein the aperture is aligned with a hole formed through the arcuate portion and adapted to provide access to a tool engageable with the fastener, and wherein the channel portion has a width which is smaller than a diameter of the rounded shell receiving surface.

7. The shell holder of claim 6, wherein the track is mounted on a rail attached externally of a receiver of the shotgun.

8. The shell holder of claim 6, wherein the body has an outer surface that includes a pair of spaced apart open end faces interconnected by the arcuate portion having a pair of sidewalls depending from opposite sides of the arcuate portion.

9. The shell holder of claim 8, wherein the external mounting surface joins the end faces and the sidewalls, and is engageable against a rail mounting surface to which the rail is secured.

10. The shell holder of claim 8, wherein the track is formed by a notch that extends continuously along the external mounting surface and opens through the sidewalls.

11. The shell holder of claim 8, wherein a slot opens through the external mounting surface between one of the end faces and the track for receiving and retaining a resilient retaining element that is frictionally engageable with an outer wall of the shotgun shell and forms pail of the shell receiving and engaging structure.

12. The shell holder of claim 11, wherein the track has a mounting axis that runs in a direction perpendicular to the sidewalls.

13. The shell holder of claim 12, wherein the body has an inner surface which includes the rounded shell receiving surface and the channel portion in communication therewith.

14. The shell holder of claim 13, wherein the shell receiving surface and the channel portion are in communication with the slot.

15. The shell holder of claim 13, wherein the shell receiving surface is radially spaced from a central axis that extends in a direction transverse to the mounting axis of the track.

16. The shell holder of claim 13, wherein the resilient retaining element projects inwardly from and extends at least partially around the shell receiving surface.

17. The shell holder of claim 6, wherein the body is mounted in a group of bodies on the rail arrangement such that the shotgun shells held in the bodies are disposed vertically and horizontally.

18. A shotgun mountable shell holder for holding a single shotgun shell therein comprising:

a rigid body having an external mounting surface provided with a track slidably mounted and frictionally retained on a rail arrangement having at least one rail attached externally of a shotgun, and an internal shell receiving and engaging structure sized and shaped to slidably receive and frictionally retain the single shotgun shell therein, wherein the track and the rail having mating dovetail-shaped cross sections, wherein the body has an outer surface that includes a pair of spaced apart open end faces interconnected by an arcuate portion having a pair of sidewalls depending from opposite sides of the arcuate portion, wherein a slot opens through the external mounting surface between one of the end faces and the track for receiving and retaining a resilient retaining element that is frictionally engageable with an outer wall of the shotgun shell and forms part of the shell receiving and engaging structure, wherein the track has a mounting axis that runs in a direction perpendicular to the sidewalls, wherein the body has an inner surface which includes a rounded shell receiving surface that extends completely through the body and a channel portion in communication therewith, wherein the channel portion is provided with an aperture that opens into the track and is configured to receive a fastener that is adapted to he secured to the rail, and wherein the aperture receiving the fastener is aligned with a hole firmed through the arcuate portion and adapted to provide access to a tool engageable with the fastener.

* * * * *